US007047574B2

(12) United States Patent
Patterson

(10) Patent No.: US 7,047,574 B2
(45) Date of Patent: May 23, 2006

(54) SYSTEM AND METHOD FOR AUTOMATICALLY VARYING A VOLUME OF A LIQUID HELD BY A TOILET RECEPTACLE

(75) Inventor: Wade C. Patterson, Huntsville, AL (US)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/375,808

(22) Filed: Feb. 27, 2003

(65) Prior Publication Data

US 2004/0168247 A1 Sep. 2, 2004

(51) Int. Cl.
*E03D 1/14* (2006.01)

(52) U.S. Cl. ..... 4/324; 4/313; 4/302

(58) Field of Classification Search ..... 4/313, 4/415, 345, 324, 314, 302, 406; 137/386, 137/392, 393, 444, 441
See application file for complete search history.

(56) References Cited

U.S. PATENT DOCUMENTS 5,036,553 A * 8/1991 Sanderson ..... 4/313
5,708,991 A * 1/1998 DeMarco ..... 4/415
5,731,758 A * 3/1998 Suttlemyre et al. ..... 340/612
5,754,986 A 5/1998 Chien ..... 4/327
5,877,429 A 3/1999 Gauley et al. ..... 73/861.77
5,920,919 A 7/1999 Chang ..... 4/378
5,940,899 A 8/1999 Mankin et al. ..... 4/427
5,966,749 A 10/1999 Goesling et al. ..... 4/392
6,058,519 A 5/2000 Quintana ..... 4/427
6,076,550 A 6/2000 Hiraishi et al. ..... 137/550
6,115,853 A 9/2000 Shibata et al. ..... 4/425
6,202,227 B1 3/2001 Gurowitz ..... 4/406
6,319,390 B1 11/2001 Kono et al. ..... 205/701
6,510,866 B1 1/2003 Li ..... 137/426

FOREIGN PATENT DOCUMENTS

JP 2002138549 A * 5/2002

* cited by examiner

*Primary Examiner*—Khoa D. Huynh
(74) *Attorney, Agent, or Firm*—Reinhart Boerner Van Deuren s.c.

(57) ABSTRACT

A toilet system comprises a liquid receptacle and a control element. The control element configured to automatically control an amount of liquid input to the liquid receptacle for each of a plurality of flushes of the liquid receptacle such that an amount of the liquid residing in the liquid receptacle between flushes is substantially varied thereby impeding formation of a chemical deposit ring on an inner surface of the liquid receptacle.

18 Claims, 7 Drawing Sheets

(5)

【図2】

SYSTEM AND METHOD FOR AUTOMATICALLY VARYING A VOLUME OF A LIQUID HELD BY A TOILET RECEPTACLE

BACKGROUND OF THE INVENTION

1. Field of the Invention

The present invention generally relates to toilet operation techniques, and more particularly to a system and method for automatically varying the volume of a liquid held by a toilet receptacle.

2. Related Art

Many different types of residential and non-residential toilets are commercially available and employed in the industry. A residential toilet typically comprises a tank and a toilet bowl. When a user initiates a flush of the toilet bowl via a flushing mechanism (e.g., a handle or a button), water within the tank is released through a flush valve into the toilet bowl, and the liquid and any waste present in the bowl are flushed out of the toilet bowl via a gravity siphon arrangement.

A common configuration of residential toilets employs a float and a ballcock valve arrangement within the toilet's liquid tank. In such an arrangement, the ballcock valve is activated by the float, which is connected to the ballcock valve via an armature. When the water within the tank is permitted to flow through the flush valve to the toilet bowl, the water level in the tank decreases rapidly causing the float that is connected to the armature to fall. When the float falls, the ballcock valve opens, and permits water to flow through the ballcock valve, and the tank refills for a subsequent flush.

In residential toilets, the volume of water held within the tank between flushes is relatively constant. Typically, approximately two (2) gallons of water is rapidly expelled from the water tank into the toilet bowl, which activates the gravity siphon arrangement thereby emptying waste and water from the toilet bowl into the sewage system. Simultaneously, the ballcock valve opens and refills the tank until the tank contains approximately two (2) gallons of water. Implementation of this mechanical process to effectuate each flush results in approximately the same amount of water residing within the tank after each flush.

In non-residential toilets, the same amount of water also flows into the toilet bowl per flush. A common configuration of non-residential toilets employs a valve and a flushing mechanism that actuates the valve during a flush. In such an arrangement, the valve is situated between a toilet bowl and an inlet conduit, which provides a water flow when the valve opens.

Moreover, the volume of water held in residential and non-residential toilets between flushes remains substantially constant throughout the life of the toilet. Chemicals (e.g., lime, calcium, etc.) within the water often accumulate at the water's surface and eventually on an inner surface of the toilet bowl forming a ring of chemical deposit on the bowl's surface. This ring is typically formed at a location on the bowl around the periphery of the surface of the water being held in the bowl. Such a ring is unsightly, and frequent cleanings of the toilet bowl are often required to prevent and/or remove a significant formation of the ring.

SUMMARY OF THE INVENTION

Generally, the present invention pertains to a system and method for automatically varying a volume of a liquid held by a toilet receptacle.

A system in accordance with one exemplary embodiment of the present invention comprises a liquid receptacle and a control element. The control element is configured to automatically control an amount of liquid input to the liquid receptacle for each of a plurality of flushes of the liquid receptacle such that an amount of the liquid residing in the liquid receptacle between flushes is substantially varied thereby impeding formation of a chemical deposit ring on an inner surface of the liquid receptacle.

A system in accordance with another exemplary embodiment of the present invention comprises a liquid receptacle and an element configured to vary the volume of a liquid in the receptacle based upon a flow rate of the liquid into the receptacle.

The present invention may further be conceptualized as a liquid volume control method comprising the steps of: initiating a plurality of flushes of a liquid receptacle within the toilet system; causing liquid to flow into and out of the liquid receptacle for each of the flushes; and substantially varying an amount of the liquid that flows into the liquid receptacle for each of the flushes thereby impeding formation of a chemical deposit ring on an inner surface of the liquid receptacle.

BRIEF DESCRIPTION OF THE DRAWINGS

The invention can be better understood with reference to the following drawings.

DETAILED DESCRIPTION

The present invention generally pertains to a system and method of automatically varying the refill volume of a liquid used to refill a liquid receptacle, such as, for example, a toilet receptacle. More specifically, a system in accordance with an exemplary embodiment of the present invention comprises a liquid receptacle for holding a liquid and a liquid volume control element, which controls an amount of liquid residing within the liquid receptacle. The liquid volume control element varies the amount of the liquid residing in the liquid receptacle thereby helping to impede the build-up of a chemical ring on the liquid receptacle.

The present invention may be employed in any system having a liquid receptacle for holding a liquid. For the purposes of illustration, the present invention will be described as varying the amount of liquid residing within a toilet receptacle (e.g., toilet bowl, urinal, etc.) within a toilet system. However, it should be readily apparent to one of ordinary skill in the art upon reading this disclosure that the techniques described herein may be employed to vary the amount of liquid held by a liquid receptacle of other types of systems.

Figure 1:
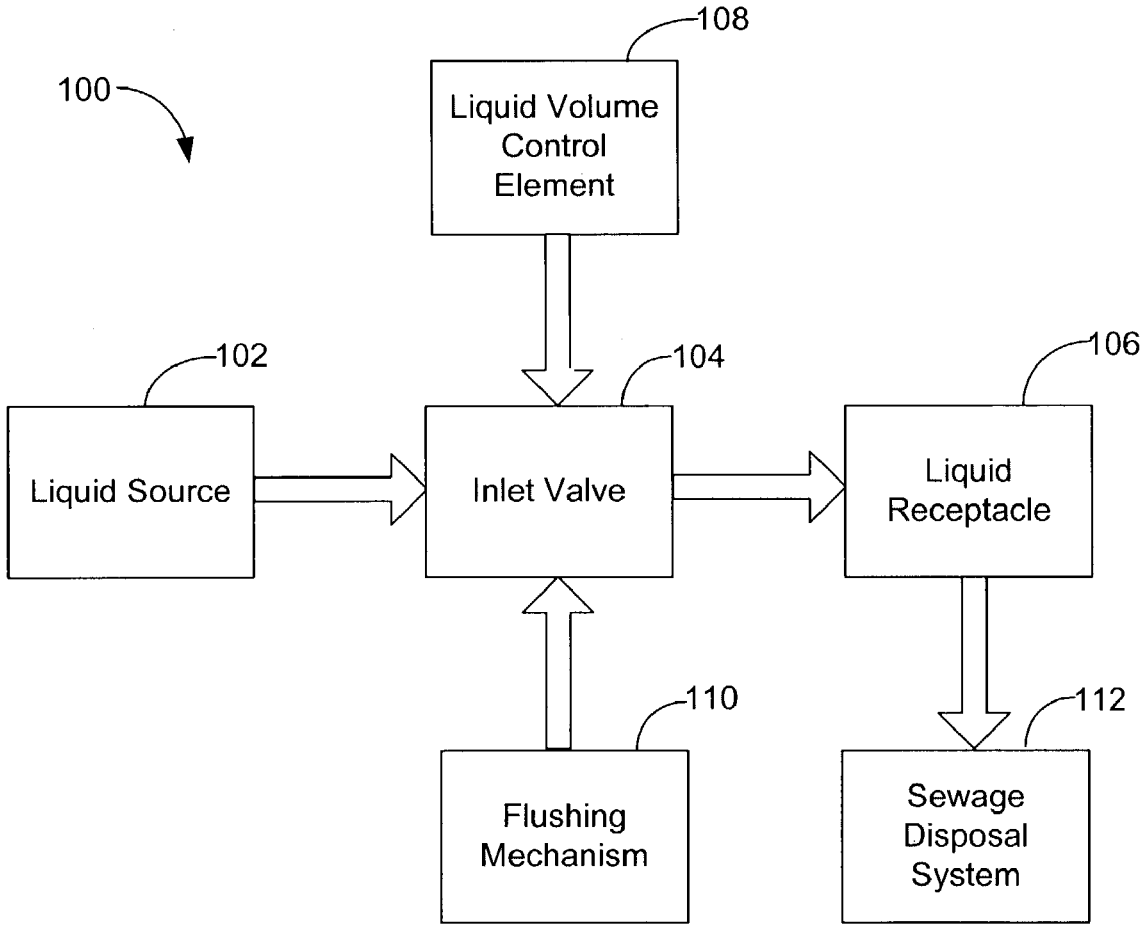
FIG. 1 is a block diagram illustrating an exemplary embodiment of the automated liquid volume control system of the present invention.

FIG. 1 is a block diagram illustrating a toilet system 100 in accordance with an exemplary embodiment of the present invention. The toilet system 100 preferably comprises a liquid source 102, an inlet valve 104, a liquid receptacle 106, and a liquid volume control element 108.

The inlet valve 104 may comprise any known or future-developed device, such as, for example, a solenoid valve or a mechanically actuated ballcock valve, for controlling the flow of a liquid (e.g., water) into or to the liquid receptacle 106. Note that liquid passing through the inlet valve 104 may proceed directly to the liquid receptacle 106 or may pass through other components before proceeding to the liquid receptacle 106.

During the course of operation of the system 100, the liquid receptacle 106 contains a volume of liquid, which is periodically flushed and refilled. To flush the liquid receptacle 106, a user activates a flushing mechanism 110, and the flushing mechanism 110, via known or future-developed techniques, activates the inlet valve 104 such that liquid from the liquid source 102 flows into the liquid receptacle 106. When this occurs, the liquid originally in the liquid receptacle 106 prior to the flush is expelled from the liquid receptacle 106 to a sewage disposal system 112, and then the liquid receptacle 106 is refilled with liquid from the liquid source 102. Eventually, the inlet valve 104 is closed, thereby completing the flush previously activated by the user.

The liquid volume control element 108 is configured to automatically vary, for different flushes, the refill volume of liquid that flows into the liquid receptacle 106 thereby varying the amount of liquid that remains in the receptacle 106 between flushes. Thus, the surface level of the liquid held by the liquid receptacle 106 between flushes is varied, and the formation of a ring of chemical deposits (e.g., lime, calcium, etc.) on an inner surface of the liquid receptacle is thereby impeded. In this regard, the formation of a chemical ring on the surface of a conventional toilet bowl is exacerbated by the fact that the surface level is at the same approximate position with respect to the toilet bowl's surface. Therefore, chemicals accumulating on the surface of the bowl's water are, over time, deposited at the same approximate location on the bowl's surface. By varying the amount of water held by the receptacle 106 between flushes as described herein, the surface level of the liquid held by the receptacle 106 between flushes is at a different position with respect to the receptacle's inner surface. Thus, the chemicals that accumulate at the liquid's surface, over time, are deposited at different locations on the receptacle's inner surface, thereby impeding the formation of a chemical ring.

To vary the refill volume of liquid that flows through the inlet valve 104, the element 108 preferably controls the actuation of the inlet valve 104 based upon a desired refill volume value, which is preferably varied for different flushes, and a liquid flow rate value indicative of an amount of liquid that flows through the inlet valve 104 per time unit (e.g., seconds, minutes or hours). As an example, a method by which the liquid volume control element 108 may vary the refill volume can be effectuated by generating, for each flush, a refill volume value that randomly falls within a predetermined range (e.g., if the liquid receptacle holds approximately one (1) gallon of liquid between flushes, then the refill volume range may be defined as 0.7 gallons to 1.3 gallons). Therefore, the liquid volume control element 108 may vary the refill volume value for consecutive flushes randomly within the specified range (e.g., four consecutive flushes may have the random values 0.8 gallons, 1.3 gallons, 0.9 gallons, and 1.1 gallons). The element 108, for each flush, then allows an amount of liquid corresponding to the flush's refill volume value to pass through the inlet valve 104. As will be described in more detail hereafter, the element 108 may utilize the liquid flow rate volume to ensure that the appropriate amount of liquid flows through the inlet valve 104 for each flush.

Note that, in other embodiments, it is not necessary for the desired refill volume values to be randomly varied. In this regard, the values may be predefined or set to a specific pattern. As an example, the liquid volume control element 108 may vary the refill volume value based upon a non-random deviation value, which may be combined with the refill volume value used for a previous flush to derive a new refill volume value for the current flush. For example, the liquid volume control element 108 may add a constant delta value of 0.1 to the refill volume values of successive flushes. In such an example, four consecutive flushes may have the refill volume values of 0.8 gallons, 0.9 gallons, 1.0 gallons, and 1.1 gallons. Note that other techniques for varying the amount of liquid that flows into and remains in the receptacle 106 for different flushes are possible.

Figure 2:
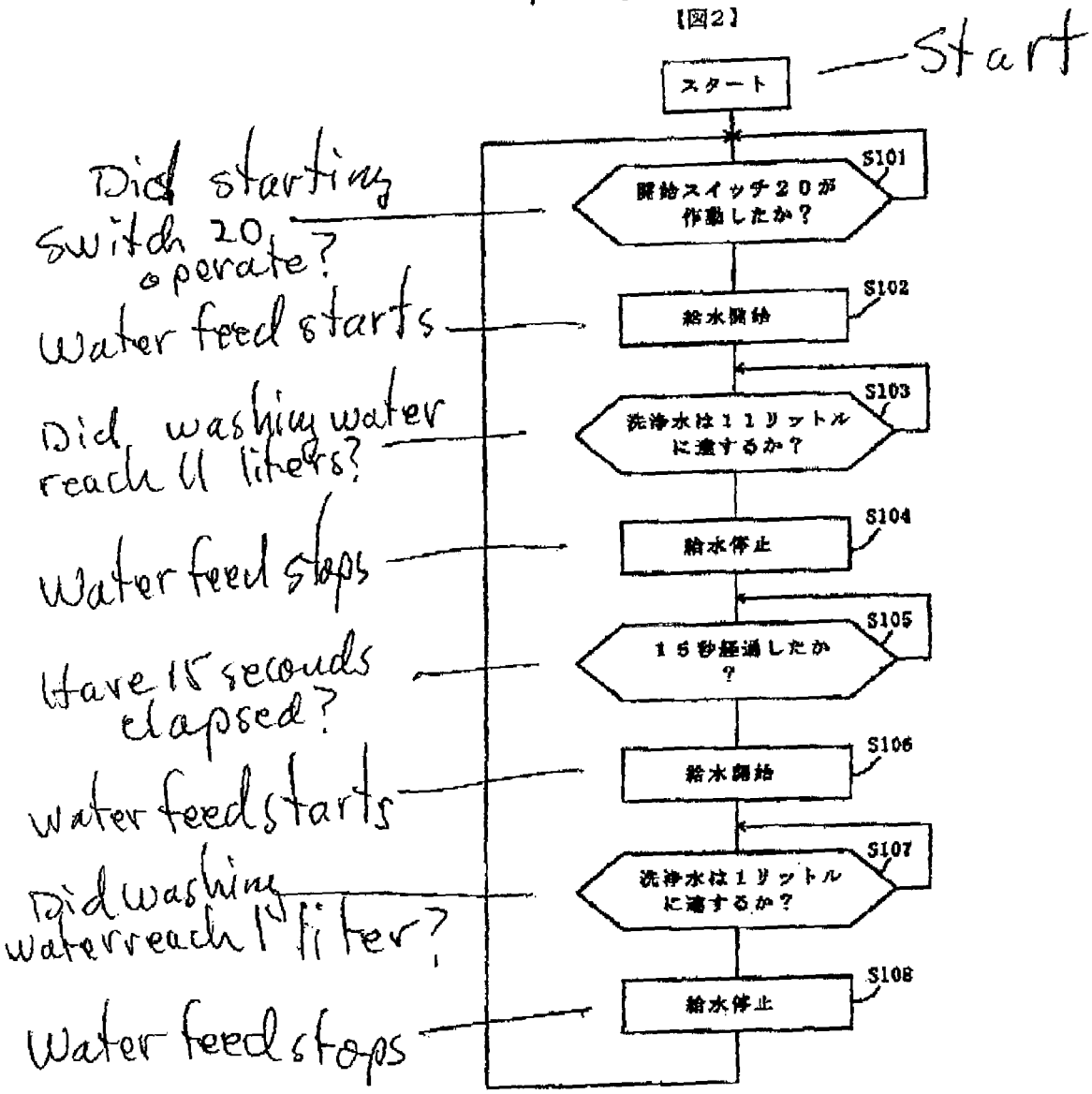
FIG. 2 is a block diagram illustrating an exemplary liquid volume control element as shown in FIG. 1.

An exemplary embodiment of the liquid volume control element 108 of the system 100 is depicted in FIG. 2. The liquid volume control element 108 depicted in FIG. 2 preferably comprises a flow rate sensor 202 and liquid volume control logic 210.

The liquid volume control logic 210, along with its associated methodology, may be implemented in hardware, software, or a combination thereof. As illustrated by way of example in FIG. 2, the liquid volume control logic 210 may be implemented in software and stored in memory 208.

When implemented in software, the volume modification logic 210 can be stored and transported on any computer-readable medium for use by or in connection with an instruction execution system, such as a computer-based system, processor-containing system, or other system that can fetch and execute the instructions. In the context of this document, a "computer-readable medium" can be any means that can contain, store, communicate, propagate, or transport a program for use by or in connection with the instruction execution system. The computer-readable medium can be, for example but not limited to, an electronic, magnetic, optical, electromagnetic, infrared, or semi-conductor system or propagation medium. Note that the computer readable medium could even be paper or another suitable medium upon which the program is printed, as the program can be electronically captured, via for instance optical scanning of a paper or other medium, then compiled, interpreted, or otherwise processed in a suitable manner if necessary, and then stored in memory. As an example, the volume modification logic 210 may be magnetically stored and transported on a conventional portable computer diskette or write-able CD-ROM.

The exemplary embodiment of the liquid volume control element 108 illustrated in FIG. 2 further comprises at least one processing element 206, such as a digital signal processor (DSP) or a central processing unit (CPU), for example that communicates to and drives the other elements in the liquid volume control element 108 via a local interface 204, which can include one or more buses. When the liquid volume control logic 210 is implemented in software, the processing element 206 may be used to execute instructions defined by the logic 210.

The flow rate sensor 202 is preferably inserted into a flow of the liquid that originates at the liquid source 102 (FIG. 1) and travels through the inlet valve 104 (FIG. 1) to the liquid receptacle 106 (FIG. 1), when the inlet valve 104 (FIG. 1) is in an open position. Note that a valve is in an "open" position when the valve allows liquid to flow through it, and is in a "closed" position when the valve prevents liquid from flowing through it. As will be described in more detail hereafter, the flow rate sensor 202 determines the rate at which liquid flows through valve 104.

Various configurations of the flow rate sensor 202 are possible without departing from the principles of the present invention. As shown by FIG. 2, an exemplary embodiment of the flow rate sensor 202 comprises a turbine 212 and conversion logic 214, which may be implemented in hardware, software, or a combination thereof. When a user of the system 100 (FIG. 1) activates a flushing mechanism 110, the flushing mechanism 110 opens the inlet valve 104, and the open inlet valve 104 permits the flow of liquid therethrough. The turbine 212 of the flow rate sensor 202 is preferably disposed within the flow of this liquid. For example, the turbine 212 may be interposed between the inlet valve 104 and the liquid receptacle 106, such that it receives the flow of liquid from the inlet valve 104 and allows the flow of liquid to proceed to the liquid receptacle 106. Alternatively, the sensor 202 may receive the flow of liquid prior to the inlet valve 104, such that it receives liquid flowing into the inlet valve 104. In another embodiment, the sensor 202 may be disposed within the inlet valve 104 and receive the liquid flowing through the valve 104.

The turbine 212 is communicatively connected to the conversion logic 214, which converts the power generated by the turbine 212, when liquid flows through the turbine 212, into an electrical signal having a value, referred to herein as the "liquid flow rate value," indicative of the volumetric flow rate of the liquid that is flowing through the turbine 212 and therefore, through the inlet valve 104.

The conversion logic 214 then preferably transmits the liquid flow rate value to the liquid volume control logic 210. Based in part on this value, the liquid volume control logic 210 determines how much liquid flows through the inlet valve 104 for a flush and controls the inlet valve 104 such that the valve 104 is closed once an amount of liquid approximately equal to the refill volume value for the current flush has flowed through the inlet valve 104. As an example, based on a clock 216, the liquid volume control logic 210 may track how long the valve 104 is in an open state once a flush is initiated. In particular, the logic 210 may determine a value, referred to as an "open valve time value," that is indicative of an amount of time that the valve 104 is to remain opened during the current flush. The logic 210 may determine this value by 6 dividing the refill volume value for the current flush by the liquid flow rate value determined for the current flush.

Once the inlet valve 104 has been in the open state for the amount of time indicated by the open valve time value, then the logic 210 is configured to close the inlet valve 104. Thus, by using different refill volume values for different flushes, the receptacle 106 is filled with different amounts of liquid for different flushes. Therefore, a build-up of a chemical ring deposit on the inner surface of the receptacle 106 is impeded. Note that, as shown in FIG. 2, the liquid volume control element 108 may comprises a clock 216 for enabling the liquid volume control logic 210 to track an amount of time that the inlet valve 104 remains open during a flush.

Figure 3:
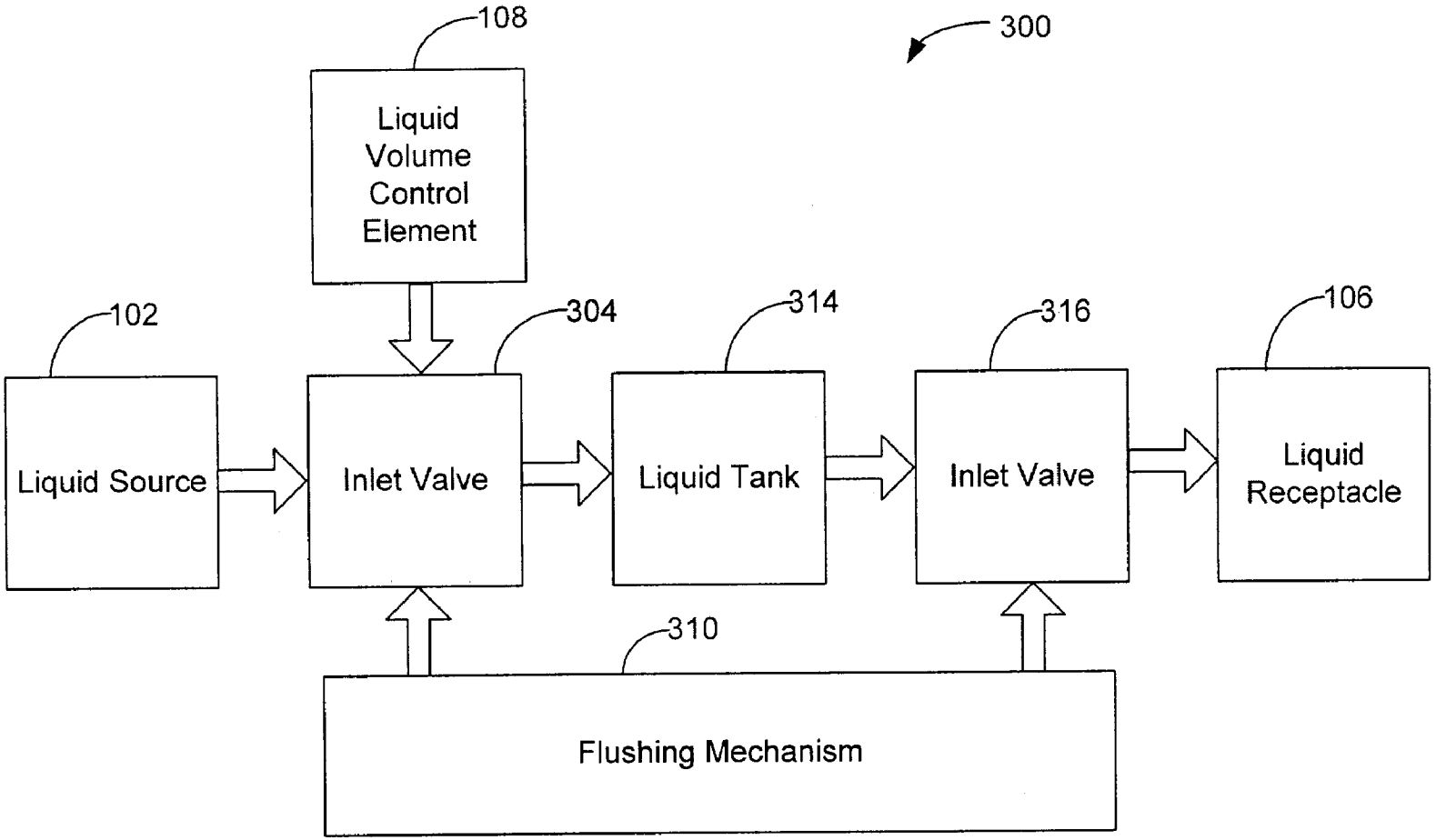
FIG. 3 is a block diagram illustrating an exemplary system as shown in FIG. 1, which illustrates a liquid volume control element that interfaces with an inlet valve interposed between a liquid source and a liquid tank.

An exemplary embodiment of a residential toilet system 300 in accordance with the present invention is illustrated in FIG. 3. The toilet system 300 comprises a liquid source 102, a first inlet valve 304, a receptacle 106, a liquid tank 314, and a second inlet valve 316. The first inlet valve 304 is preferably interposed between the liquid source 102 and the liquid tank 314 and is configured to permit liquid to flow from the liquid source 102 to the liquid tank 314 when the inlet valve 104 is in an open state. According to the techniques described hereinabove, a liquid volume control element 108 is configured to control the liquid volume that passes through the first inlet valve 304 during a flush.

In this regard, a user initiates a flush via a flushing mechanism 310, which opens the first and second inlet valves 304 and 316. When the second inlet valve 316 opens, it permits liquid within the liquid tank 314 to empty into the liquid receptacle 106. When the first inlet valve 304 opens, it permits liquid to flow from the liquid source 102 to the liquid tank 314, thereby refilling the liquid tank 314 for a subsequent flush. Per each flush initiated by the flushing mechanism 310, the liquid volume control element 108 varies the volume of liquid permitted to flow through inlet valve 304 thereby varying the volume of liquid within liquid receptacle 106 per each flush.

Figure 4:
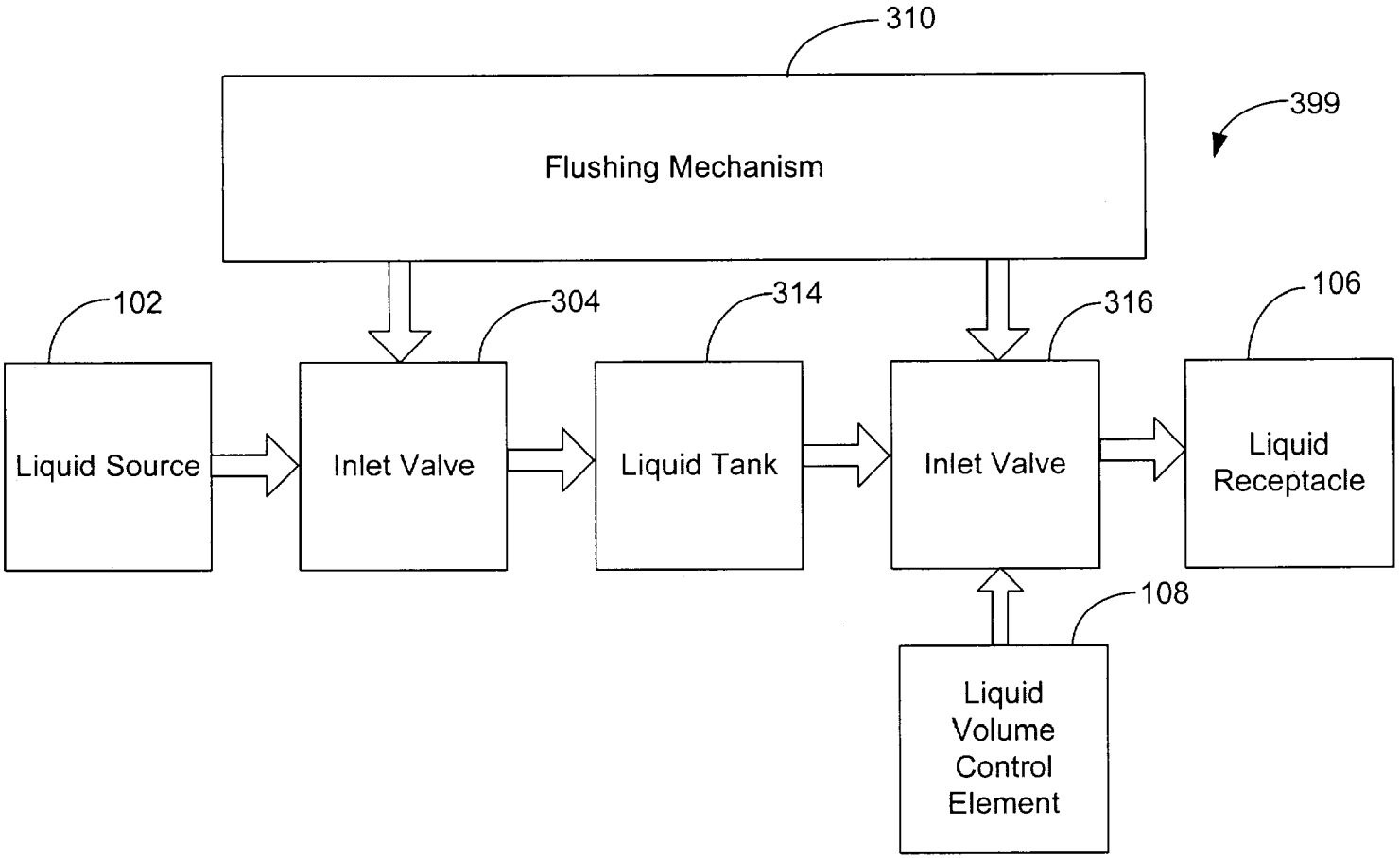
FIG. 4 is a block diagram illustrating an exemplary system as shown in FIG. 1, which illustrates a liquid volume control element that interfaces with an inlet valve interposed between a liquid tank and a liquid receptacle.

Another exemplary embodiment of a residential toilet system 399 in accordance with the present invention is illustrated in FIG. 4. Like the system 300, the toilet system 399 comprises a liquid source 102, a first inlet valve 304, a receptacle 106, a liquid tank 314, and a second inlet valve 316. The first inlet valve 304 is preferably interposed between the liquid tank 314 and the liquid receptacle 106 and is configured to permit liquid to flow from the liquid tank 314 to the liquid receptacle 106 when the inlet valve 304 is in an open state. According to the techniques described hereinabove, the liquid volume control element 108 is configured to control the liquid volume that passes through the second inlet valve 316 when it is in an open state.

In this regard, a user initiates a flush via a flushing mechanism 310, which opens the first and second inlet valves 304 and 316. When the second inlet valve 316 opens, it permits liquid within the liquid tank 314 to empty into the liquid receptacle 106. When the first inlet valve 304 opens, it permits liquid to flow from the liquid source 102 to the liquid tank 314, thereby refilling the liquid tank 314 for a subsequent flush. Per each flush initiated by a user via the flushing mechanism 310, the liquid volume control unit 108 varies the volume of liquid permitted to flow through second inlet valve 316 thereby varying the volume of liquid within liquid receptacle 106 per each flush.

Figure 5:
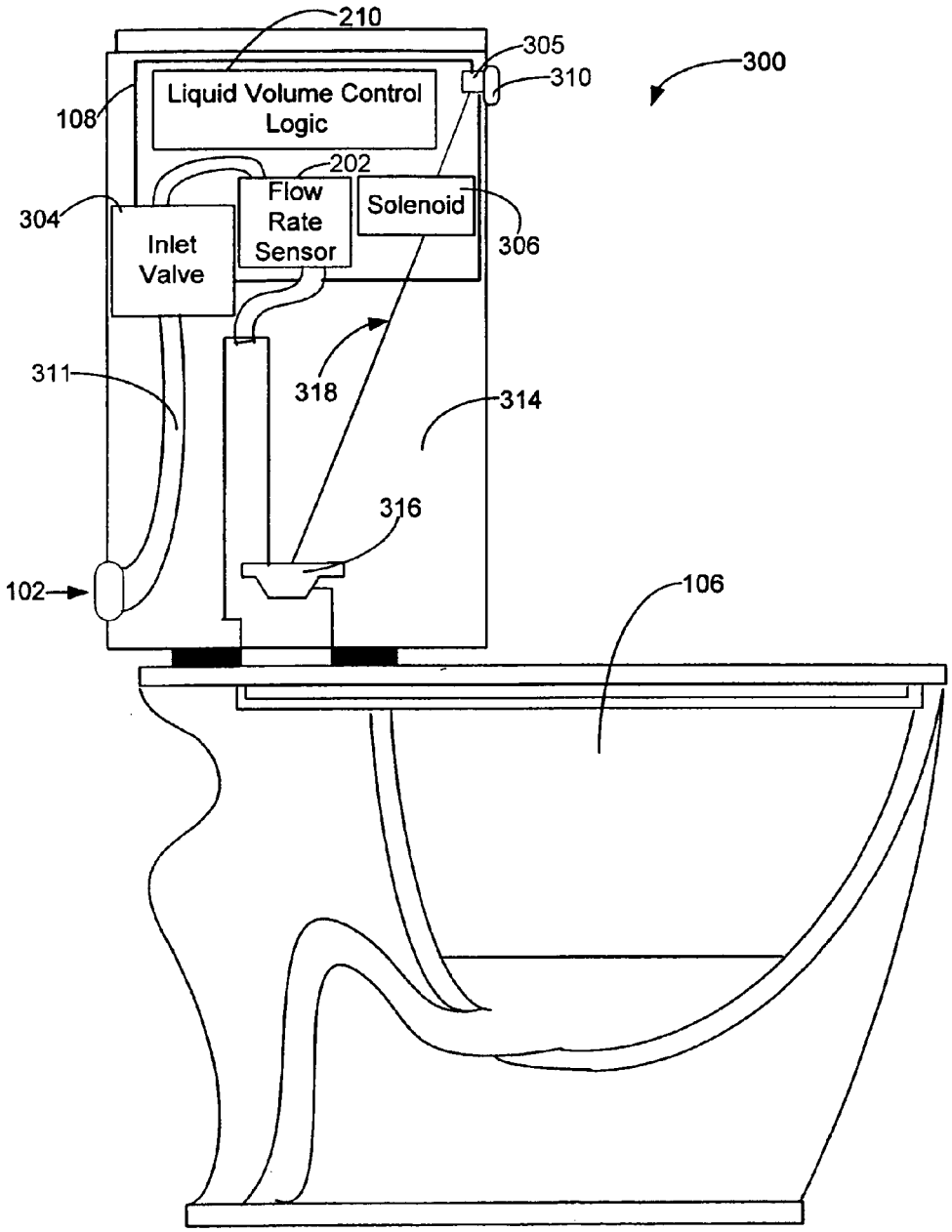
FIG. 5 is a pictorial diagram illustrating the exemplary liquid volume control element of FIG. 2 in a residential toilet system.

A detailed view of the residential toilet system 300 is depicted in FIG. 5. As shown by FIG. 5, the system 300 comprises a liquid receptacle 106 and a tank 314 that houses a liquid volume control element 108, a solenoid 306 that is configured to actuate a valve 316 via a control link 318, and an inlet valve 304 that controls liquid flowing from a liquid source 102 to the liquid tank 314. For illustrative purposes, assume that the liquid receptacle 106 is designed to hold one (1) gallon of liquid between successive flushes. A user of the toilet system 300 activates a flushing mechanism 310. The flushing mechanism 310 is preferably mechanically coupled to a switch 305, and the flushing mechanism 310 activates this switch 305 in response to user activation of the flushing mechanism 310. When activated, the switch 305 activates the solenoid 306. Activation of the solenoid 306 causes the solenoid 306 to open the valve 316 that allows liquid to flow from the tank 314 to the receptacle 106.

In addition, the switch 305 activates the inlet valve 304, which may be effectuated by a solenoid mechanism (not shown), and permits liquid flow through conduit 311 into liquid tank 314. The flow rate sensor 202 is activated by the liquid flow through conduit 311, and in response to activation by the liquid flow, the flow rate sensor 202 outputs the liquid flow rate value indicative of the volumetric liquid flow through the conduit 311.

The liquid volume control logic 210 receives the liquid flow rate value from the flow rate sensor 202, and it determines a current refill volume for the current flush that is preferably different from the previous refill volume value, which is indicative of the amount of liquid residing in the tank 314 prior to the current flush.

For example, the liquid volume control logic 210 may be configured to retain in a memory 208 (FIG. 2) the previous refill volume value and to add or subtract a deviation to the previous refill volume value in order to produce the current refill volume value. As an example, if the previous refill volume value corresponds to 0.8 gallons, then the liquid volume control logic 210 may set the current refill volume value to correspond to 0.9 gallons or 0.7 gallons. Note that the deviations combined with the previous refill volume values may be varied via any known or future-developed algorithm such that each refill volume value remains within a specified range. As an example, constant or varying deviations may be added to the previous refill volume values until a specified maximum is reached. When this occurs, a constant or varying deviation may be subtracted from the previous refill volume values until a specified minimum is reached at which point the process of adding deviations is repeated.

After the liquid volume control logic 210 determines a current refill volume value for the current flush, it then calculates the open valve time value for the current flush based upon the volumetric flow rate obtained from flow rate sensor 202, once the inlet valve 304 is opened for the current flush, and the current refill volume value. In this regard, the liquid volume control logic 210 preferably determines an open valve time value with the following formula:

$$T_o = V_w / F_w,$$

where $T_o$ represents the valve open valve time value of valve 304, $V_w$ represents the current refill volume value, and $F_w$ represents the flow rate obtained from the flow rate sensor 202 for the current flush.

For example, if the liquid volume control logic 210 receives a signal from the flow rate sensor 202 that indicates a volumetric flow rate of twenty (20) gallons per minute during the current flush, and the desired refill volume for the current flush is one (1.0) gallons, then the liquid volume control logic 210 preferably calculates a valve open time for valve 304 represented by the following formula:

$$T_o = 1.0 \text{ gallons}/20 \text{ gallons/minute}$$

$$T_o = 0.05 \text{ minutes} = 3 \text{ seconds},$$

Therefore, the liquid volume control logic 210 calculates an open valve time value for the valve 304, in order to permit a refill volume of 1.0 gallons, of three (3) seconds.

After calculating the open valve time value for valve 304, the liquid volume control logic 210 transmits a signal to the inlet valve 304, which causes valve 304 to close when the calculated open valve time has elapsed. Note that the elapse of the valve open time is calculated from the time the valve 304 opens. Therefore, the liquid volume control logic 210 may comprise a timer, begin tracking time, based on the clock 216, once the valve 304 is opened by the flushing mechanism 310 for the current flush and may transmit a signal for closing the valve 304 when the monitored tie exceeds the time indicated by the open valve time value. Thus, the liquid volume control logic 210 permits liquid flow through the valve 304 only for the calculated amount of time that will effectuate the desired refill volume indicated by the current refill volume value.

As noted herein, the liquid volume control logic 210 may randomly generate the current refill volume value for the current flush. For example, the liquid volume control logic 210 may, as previously indicated above, define a range of refill volume values indicative of refill volumes within a specified range, for example, between 0.7 gallons and 1.3 gallons. The liquid volume control logic 210 may then determine the current a refill volume value for the current flush by randomly selecting a refill volume value within the defined range.

Moreover, in the example provided, for each consecutive flush of the liquid receptacle 106, the volume of liquid contained within the liquid receptacle 106 preferably varies thereby impeding a build-up of a chemical ring on the inner surface of the receptacle 106.

Note that employing the flow rate sensor 202 to obtain a flow rate value indicative of the volumetric flow rate of the liquid through the inlet valve 304 represents one embodiment of the present invention. Other devices or methods for obtaining a flow rate value may be implemented in other embodiments of the present invention. As an example, a flow rate value may be a predetermined constant value, and the logic 210 may use the predetermined constant value for each flush to calculate the open valve time value discussed herein.

Figure 6:
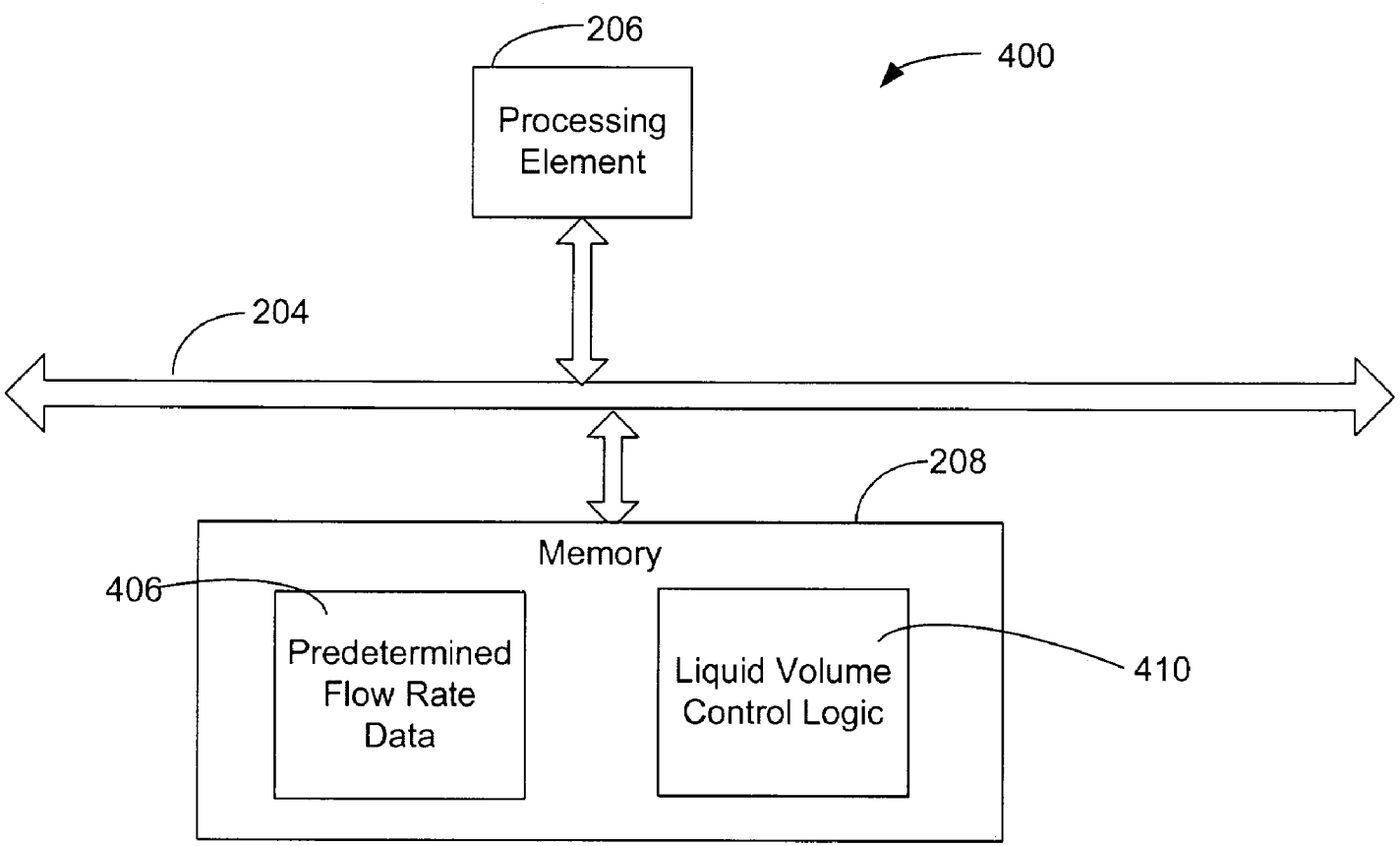
FIG. 6 is a block diagram illustrating an exemplary volume modification element as shown in FIG. 1.

Another exemplary embodiment of the liquid volume control element 108 of the system 100 (FIG. 1) is depicted in FIG. 6 and is designated generally throughout as system 400. The liquid volume control element 400 depicted in FIG. 4 preferably comprises a processing element 206, and liquid volume control logic 410 and predetermined flow rate data 406 stored in memory 208.

As discussed above, when a user of the system 100 (FIG. 1) activates a flushing mechanism 110, the flushing mechanism 110 opens the inlet valve 104, and the open inlet valve 104 permits the flow of liquid from the source 102 to the receptacle 106. However, rather than determining the flow rate for the current flush via a flow rate sensor 202, the liquid volume control logic 410 assumes that the actual flow rate corresponds to a predetermined flow rate that is stored in predetermined flow rate data 406. Thus the logic 410 uses the predetermined flow rate value to control the inlet valve 104 in the same manner that control logic 210 of FIG. 2 uses the flow rate value from sensor 202 to control the inlet valve 104.

In particular, the liquid volume control logic 410 is preferably configured to calculate a value indicative of an open valve time for the inlet valve 104. The value indicative of an open valve time for the inlet valve 104 is calculated based upon the predetermined volumetric flow rate value obtained from memory 208 and a desired refill volume, which may be based upon a random refill volume or a non-random value. The liquid volume control logic 410 then closes the inlet valve after the open valve time has elapsed and the inlet valve 104 permits the desired refill volume to flow into the receptacle 106.

Note that the embodiments discussed herein comprise a liquid tank 314, which is illustrated in FIG. 3 and FIG. 4. However, a liquid tank is not an integral element of the present invention, and it is not necessary for other embodiments of the invention to utilize a liquid tank 314. For example, non-residential toilets typically do not comprise a liquid tank. Instead, non-residential toilet systems typically comprise the inlet valve that permits water to flow directly into the water receptacle of the toilet system. Similarly, the toilet system 100 of the present invention may be configured, in one exemplary embodiment, such that liquid from the inlet valve flows into the liquid receptacle 106 without first passing through a water tank 314. In such an embodiment, the liquid volume control element 108 may control the inlet valve 104 via the same techniques described above in order to cause the amount of water held by the receptacle 106 between flushes to vary.

Figure 7:
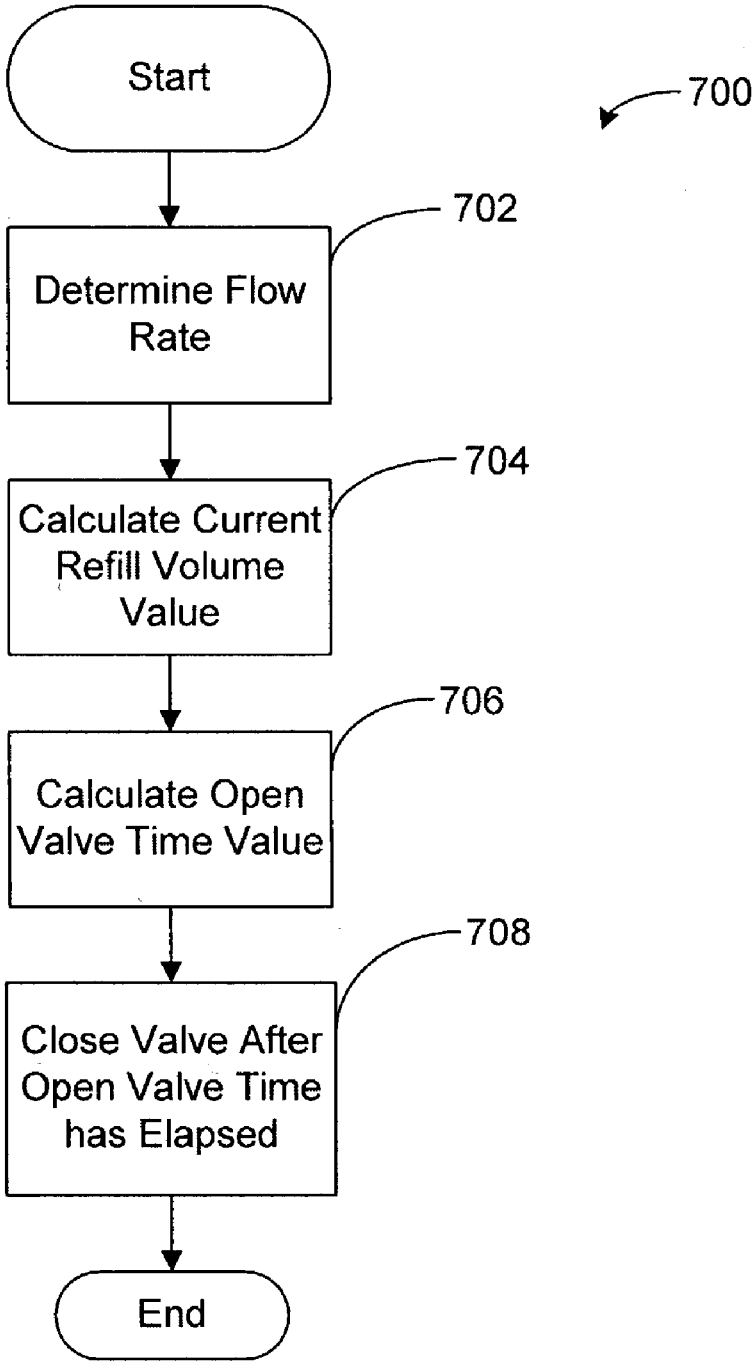
FIG. 7 is a flowchart illustrating an exemplary architecture and functionality of the liquid volume control element shown in FIG. 1.

FIG. 7 illustrates an exemplary architecture of the operation and functionality of a liquid volume control element 108 of FIG. 1 of the present invention, and is generally referred to throughout as liquid volume control process 700.

When a user of a system 100 activates a flush via flushing mechanism 110 of a liquid receptacle 106, then the liquid volume control element 108 determines a volumetric flow rate of liquid through the inlet valve 104, as indicated in step 702. Such a flow rate may be determined via a flow rate sensor 202 (FIG. 2), which interfaces with the flow of the liquid and outputs a value indicative of the volumetric flow rate of the liquid. In addition, the volumetric flow rate may be a predetermined constant value (e.g., the rate at which liquid empties into the liquid receptacle 106 may be determined in testing environment and stored in a memory element of the liquid volume control element 108).

The liquid volume control element 108 preferably then calculates a refill volume for the current flush, as indicated in step 704. The current refill volume value is preferably based upon a desired range of refill volume values for the system 100. The liquid volume control element 108 may determine a current refill volume value by incrementing or decrementing the previous refill volume by a non-random value (e.g., the non-random value may be a predetermined constant deviation value). In addition, the liquid volume control element 108 may employ a random value, which it selects from a desired range of refill volume values. Other techniques for determining a current refill volume value are possible as well.

The liquid volume control element 108 may then calculate a valve open valve time value for the inlet valve 104, as indicated in step 706. As discussed herein, the calculated open valve time value may be based upon a calculated or predetermined flow rate and a current refill volume value determined in steps 702 and 704, respectively.

As indicated in step 708, the liquid volume control element 108 then closes the inlet valve 104 when the valve open time calculated in step 706 has elapsed since the inlet valve 104 was opened for the current flush. Thus by determining different refill volume values for different flushes, the amount of liquid used to refill the receptacle 106 substantially varies. As a result, the amount of liquid held by the receptacle 106 is substantially varied over time helping to impede a build-up of a chemical ring on the inner surface of the receptacle 106.

The invention claimed is:

1. A system for varying the volume of liquid held by a toilet bowl following a flush, said system comprising:

an inlet valve interposed between a source of liquid and a toilet bowl, wherein said inlet valve has an open position in which said inlet valve allows liquid from the source of liquid to enter the toilet bowl and a closed position in which said inlet valve prevents liquid from the source of liquid from entering the toilet bowl;

a flushing mechanism which is operatively connected to actuate said inlet valve, causing it to go from said closed position to said open position when said flushing mechanism is actuated, allowing liquid from the source of liquid to enter the toilet bowl to flush the toilet bowl, whereupon the liquid entering the toilet bowl causes the contents of the toilet bowl to be substantially expelled from the toilet bowl into a sewage disposal system in a flushing operation, following which the liquid entering the toilet bowl refills the toilet bowl; and a liquid volume controller which controls the closing of said inlet valve to vary the volume of liquid held by the toilet bowl following each flush such that the level of the liquid held by the toilet bowl following flushing is varied and the formation of a ring of chemical deposits on the toilet bowl is thereby impeded.

2. A system as defined in claim 1, wherein the volume of liquid within the toilet bowl following flushes is varied within a predetermined range.

3. A system as defined in claim 2, wherein the volume of liquid held by the toilet bowl following flushes varies in a predetermined range between a minimum volume and a maximum volume.

4. A system as defined in claim 3, wherein the volume of liquid held by the toilet bowl following flushes varies randomly within said predetermined range between said minimum volume and said maximum volume.

5. A system as defined in claim 3, wherein the volume of liquid held by the toilet bowl following flushes varies within said predetermined range between said minimum volume and said maximum volume according to a specific pattern.

6. A system as defined in claim 3, wherein the volume of liquid held by the toilet bowl following flushes between consecutive flushes varies within said predetermined range between said minimum volume and said maximum volume according to a specific pattern.

7. A system as defined in claim 3, wherein said predetermined range between said minimum volume and said maximum volume varies by at least approximately ten percent above and below a nominal volume.

8. A system as defined in claim 7, wherein said predetermined range between said minimum volume and said maximum volume varies by as much as approximately thirty percent above and below said nominal volume.

9. A system as defined in claim 3, wherein said predetermined range between said minimum volume and said maximum volume has at least three different values for the volume of liquid held by the toilet bowl following flushes.

10. A system as defined in claim 9, wherein said predetermined range between said minimum volume and said maximum volume has as many as seven different values for the volume of liquid held by the toilet bowl following flushes.

11. A system as defined in claim 1, wherein said flushing mechanism comprises:

a solenoid which is operatively connected to drive said inlet valve between said closed position and said open position.

12. A system as defined in claim 11, wherein said flushing mechanism additionally comprises:

a manually actuated switch for initiating the flushing of the toilet bowl, said switch being operatively connected to actuate said solenoid to drive said inlet valve from said closed position to said open position when said switch is actuated.

13. A system as defined in claim 1, wherein the toilet bowl has an associated water storage tank which is filled following each flush and is emptied into the toilet bowl to produce a flush, wherein said inlet valve is located between the water storage tank and the toilet bowl and wherein said open position of said inlet valve allows liquid from the water storage tank to enter the toilet bowl and said closed position of said inlet valve prevents liquid from the water storage tank from entering the toilet bowl, said system additionally comprising:

a further inlet valve located between the source of liquid and the water storage tank, wherein said further inlet valve has an open position in which said further inlet valve allows liquid from the source of liquid to enter the water storage tank and a closed position in which said further inlet valve prevents liquid from the source of liquid from entering the water storage tank.

14. A system as defined in claim 13, wherein said liquid volume controller is configured to calculate a value indicative of a desired refill volume for the toilet bowl during each flushing operation, said liquid volume controller then controlling the closing of said further inlet valve to provide the calculated desired refill volume for that flush to the toilet bowl.

15. A system as defined in claim 14, wherein said liquid volume controller provides the calculated desired refill volume for each flush to the toilet bowl by calculating an open valve time value for each flush during which open time value said first-mentioned inlet valve remains open.

16. A system as defined in claim 14, wherein said liquid volume controller provides the calculated desired refill volume for each flush to the toilet bowl by monitoring the flow of liquid from the source of liquid and the toilet bowl and allowing said further inlet valve to remain open until the calculated desired refill volume for the flush is achieved.

17. A system for varying the volume of liquid held by a toilet bowl following a flush, said system comprising:

a first inlet valve interposed between a source of liquid and a liquid storage tank, wherein said first inlet valve has an open position in which said first inlet valve allows liquid from the source of liquid to enter the liquid storage tank and a closed position in which said first inlet valve prevents liquid from the source of liquid from entering the liquid storage tank;

a second inlet valve interposed between the liquid storage tank and the toilet bowl, wherein said second inlet valve has an open position in which said second inlet valve allows liquid from the liquid storage tank to enter the toilet bowl and a closed position in which said second inlet valve does not allow liquid from the liquid storage tank to enter the toilet bowl;

a flushing mechanism which is operatively connected to actuate said second inlet valve, causing it to go from said closed position to said open position when said flushing mechanism is actuated, allowing liquid from the liquid storage tank to enter the toilet bowl to flush the toilet bowl, whereupon the liquid entering the toilet bowl causes the contents of the toilet bowl to be substantially expelled from the toilet bowl into a sewage disposal system in a flushing operation, following which the liquid entering the toilet bowl refills the toilet bowl; and a liquid volume controller which controls the operation of one of said first and second inlet valves to refill the liquid storage tank following each flush, wherein said liquid volume controller automatically varies the volume of liquid held by the toilet bowl following each flush such that the level of the liquid held by the toilet bowl following flushing is varied and the formation of a ring of chemical deposits on the toilet bowl is thereby impeded.

18. A system for varying the volume of liquid held by a toilet bowl following a flush, said system comprising:

a valve interposed between a source of liquid and a toilet bowl, said valve having open and closed positions;

a flushing mechanism which, when actuated, causes said valve to go from said closed position to said open position, allowing liquid from the source of liquid to enter the toilet bowl to flush the toilet bowl, following which the liquid entering the toilet bowl refills the toilet bowl; and a liquid volume controller which controls the operation of said valve to automatically vary, for different flushes, the refill volume of liquid that flows into the toilet bowl, thereby varying the amount of liquid that remains in the toilet bowl between flushes.

* * * * *